United States Patent [19]

Labrijn

[11] Patent Number: 5,052,106

[45] Date of Patent: Oct. 1, 1991

[54] ELECTRIC SHAVER

[75] Inventor: Hans Labrijn, Zwijndrecht, Netherlands

[73] Assignee: U.S. Philips Corp., New York, N.Y.

[21] Appl. No.: 516,010

[22] Filed: Apr. 27, 1990

[30] Foreign Application Priority Data

May 18, 1989 [NL] Netherlands ..... 8901233

[51] Int. Cl.[5] ..... B26B 19/06; B26B 19/28

[52] U.S. Cl. ..... 30/34.1; 30/45

[58] Field of Search ..... 30/34.1, 45, 43, 43.6, 30/41, 41.6, 346, 51, 44

[56] References Cited

U.S. PATENT DOCUMENTS

| | | | |
|---|---|---|---|
| 3,690,000 | 9/1972 | Loner . | |
| 3,781,990 | 1/1974 | Loner . | |
| 4,283,848 | 8/1981 | Messinger et al. | 30/34.1 |
| 4,426,776 | 1/1984 | Kakumoto et al. | 30/34.1 |
| 4,505,036 | 3/1985 | Ochiai et al. | 30/34.1 |
| 4,744,144 | 5/1988 | Lowery et al. | 30/45 |
| 4,845,847 | 7/1989 | Yasunaka et al. | 30/34.1 |
| 4,941,259 | 7/1990 | Wolf | 30/34.1 |

FOREIGN PATENT DOCUMENTS

| | | |
|---|---|---|
| 2028063 | 9/1971 | Fed. Rep. of Germany . |
| 2517922 | 11/1975 | Fed. Rep. of Germany . |

*Primary Examiner*—Douglas D. Watts
*Assistant Examiner*—Paul M. Heyrana, Sr.
*Attorney, Agent, or Firm*—Ernestine C. Bartlett

[57] ABSTRACT

An electric shaver is provided with a shaving part for short hair and a trimmer for long hair which can be moved relative to the shaving part, one wall of the shaver having a first control element which is coupled to an ON/OFF switching device for a drive mechanism, and another wall of the shaver having a second control element for movement of the trimmer. The shaver is provided with a third control element which is situated near the second control element, and which is also coupled to an ON/OFF switch for the drive mechanism.

7 Claims, 2 Drawing Sheets

ELECTRIC SHAVER

FIELD OF THE INVENTION

The invention relates to an electric shaver with a shaving part for short hair and a trimmer for long hair which can be moved relative to the shaving part, one wall of the shaver having a first control element which is coupled to an ON/OFF switching device for a drive mechanism, and another wall of the shaver having a second control element for movement of the trimmer.

BACKGROUND OF THE INVENTION

Such a shaver is known, e.g. from DE-PA 2,517,922. The trimmer is generally used for finishing off the boundaries of parts of the face where hair is growing, such as near the temples and near the moustache. For this, accurate positioning of the shaver relative to these parts is necessary.

In the known shaver, the drive mechanism can be switched on first by the first control element, and the trimmer is then moved by means of the second control element. The trimmer thus has to be positioned while switched on, which means that there is a risk of hair being trimmed prematurely and at the wrong places.

It is also possible to bring the trimmer into the operational position first by means of the second control element and only then to set the drive in operation by means of the first control element. For this, however, the grip of the hand on the shaver has to be changed, because the control elements are situated in different wall parts of the shaver. A careful positioning of the shaver relative to the part of the face to be treated is thus lost again.

SUMMARY OF THE INVENTION

The object of the invention is to produce a solution to the difficulties outlined above, and it is characterized in that the shaver is provided with a third control element, which is situated near the second control element and is also coupled to an ON/OFF switching device for the drive mechanism.

It is now possible to set the trimmer in the operational state by means of the second control element and to position the trimmer precisely relative to the hairline to be cut, without the trimmer being driven. The drive can then be switched on by means of the third control element, e.g. using the same finger as the one which has operated the second control element. The grip of the hand need not be changed here, so that the careful positioning of the trimmer is not disturbed.

In preferred embodiments of the invention:

- the drive mechanism is provided with an electric motor and a first control element for an electric switch in a supply circuit of the electric motor, and the third control element is mechanically coupled to the electric switch; and/or
- the third control element is mechanically coupled to the second control element; and/or
- the third control element is coupled to a second electric switch parallel to the first electric switch; and/or
- the third control element is designed as a part of the second control element for moving the trimmer; and/or
- the second control element can be moved between a first position corresponding to a non-operational position of the trimmer and a second position corresponding to an operational position of the trimmer, wherein the third control element is blocked in the first position of the second control element; and/or
- the third control element is also designed as a control element for a mechanism for regulating the motor speed; and/or
- the third control element is also a control element for a mechanical coupling mechanism between the shaving part and the drive mechanism.

BRIEF DESCRIPTION OF THE DRAWING

The invention will be explained below with reference to a description of a number of examples of embodiments shown in the figures.

DETAILED DESCRIPTION OF THE PREFERRED EMBODIMENTS

Figure 1:
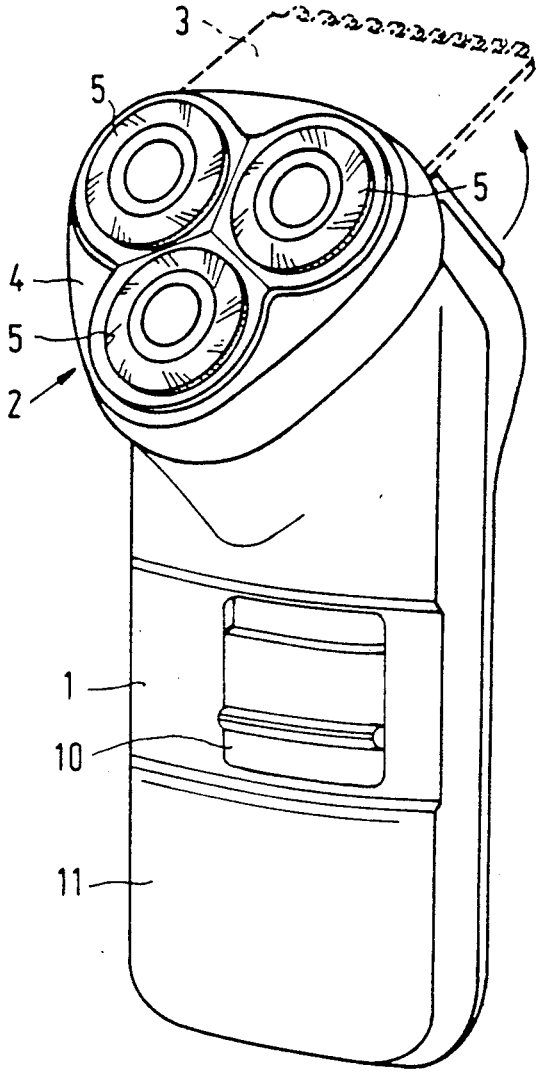
FIG. 1 shows an electric shaver in perspective.
Figure 2:
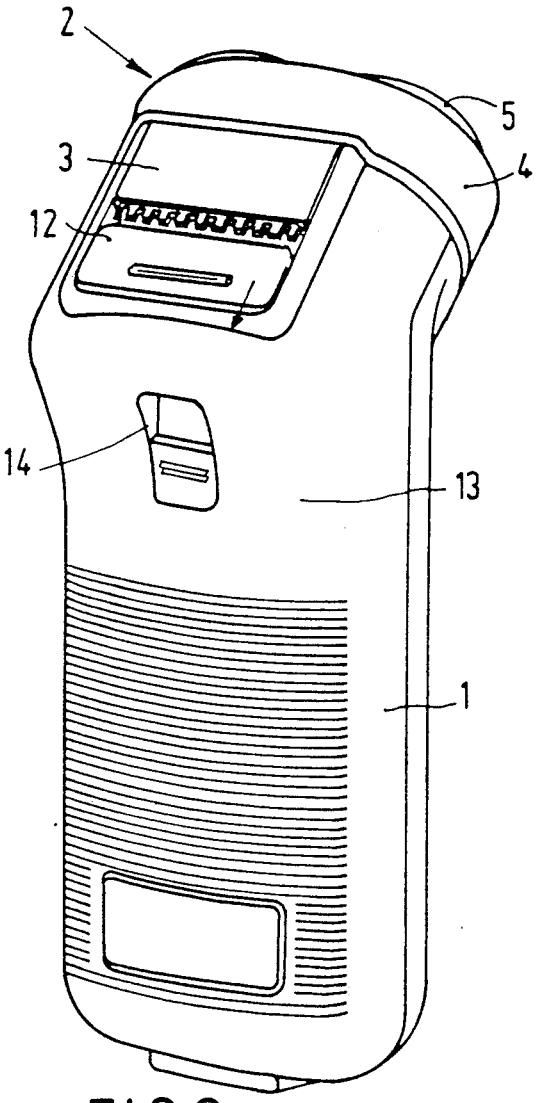
FIG. 2 shows the electric shaver of FIG. 1; also in perspective from another visual angle.

The electric shaver of FIGS. 1 and 2 comprises a housing 1 with a shaving part 2 for short hair and a trimmer 3 for long hair. The shaving part 2 comprises mainly a holder 4 with three cutting units 5 of the so-called rotary type, which are known per se. Both the shaving part 2 and the trimmer 3 have as a drive mechanism an electric motor 6 which is accommodated in the housing 1, and which is shown schematically in FIG. 3. The housing 1 also contains a power source for supplying the motor, e.g. a rechargeable battery 7. The ON/OFF switch for the motor 6 is formed by the electric switch 8 accommodated in the supply circuit 9. A control element 10, in the form of a sliding button, is accommodated in a wall 11 at the front side (FIG. 1) of the shaver and is coupled to the electric switch 8.

The trimmer 3 is movable relative to the shaving part 2 between a first non-operational position shown in FIG. 2 and an operational position shown by dotted lines in FIG. 1. For this purpose, the appliance is provided with a second control element in the form of a sliding button 12 on the rear wall 13 (FIG. 2), said sliding button being connected mechanically to the trimmer 3 in a known manner.

Figure 3:
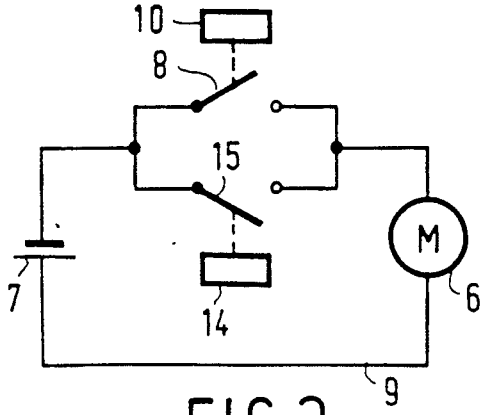
FIG. 3 shows the electrical circuit of the electric shaver according to FIGS. 1 and 2.

The appliance is provided with a third control element 14 which is situated near the second control element 12 on the rear wall 13. The third control element 14 is coupled to an electric switch 15 which is accommodated parallel to the switch 8 in the supply circuit 9 for the electric motor 6 (FIG. 3). A control element can, of course, be designed as a push button or a slide button, or otherwise.

The electric shaver can now be taken in the hand in a suitable position for use of the trimmer, following which, e.g. using the thumb, the second control element 12 can be moved and the trimmer 3 flipped out. After the trimmer is placed in position relative to the hair to be trimmed, it is then possible to move the third control element 14 using the same thumb, without changing one's grip on the appliance, so that the motor 6 is switched on and the trimming operation can be carried out. The ease of use of the appliance and the accuracy with which the trimming can be carried out are increased considerably in this way. The trimmer is not driven until the correct position relative to the hair to be trimmed is reached, thereby avoiding superfluous energy consumption and premature cutting of hair where it is not desired.

Figure 4:
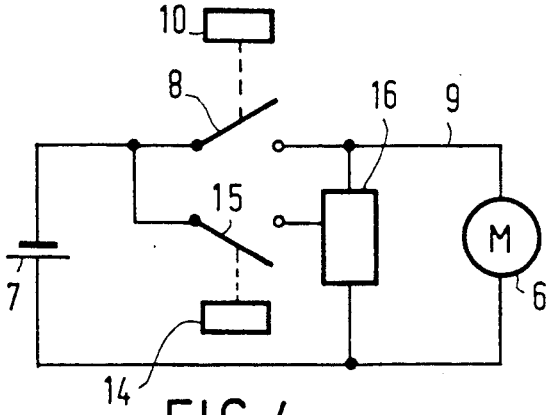
FIG. 4 is a variant of the electrical circuit of FIG. 3.

The electrical circuit shown in FIG. 4 has, in addition to the parts of the circuit shown in FIG. 3, a control mechanism 16 for the motor speed. The speed of revolution of the motor will generally be adapted to the shaving part. In this way, it is, however, possible for the motor to be driven at the motor speed most expedient for trimming. The control mechanism 16 can be designed, e.g. as a DC-DC converter, and it is switched on or off by means of the third control element 14 via switch 15.

Figure 6:
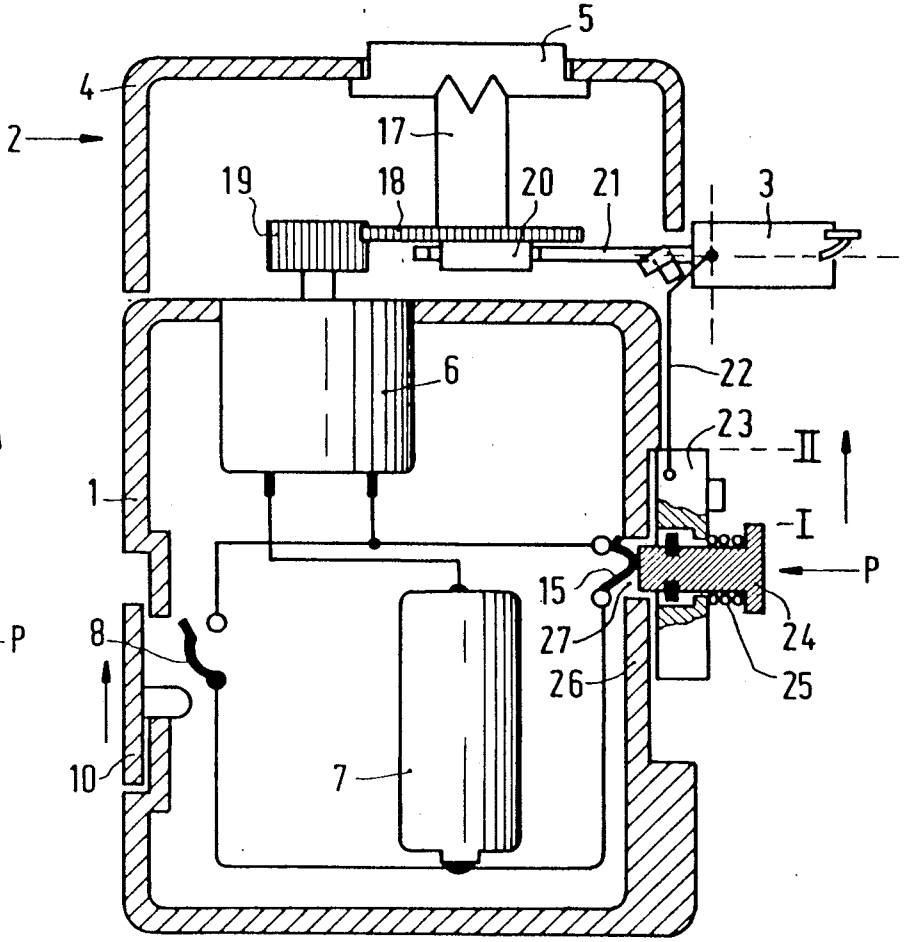
FIGS. 5 and 6 show schematically in cross-section another embodiment of an electric shaver with different positions of the trimmer.
Figure 5:
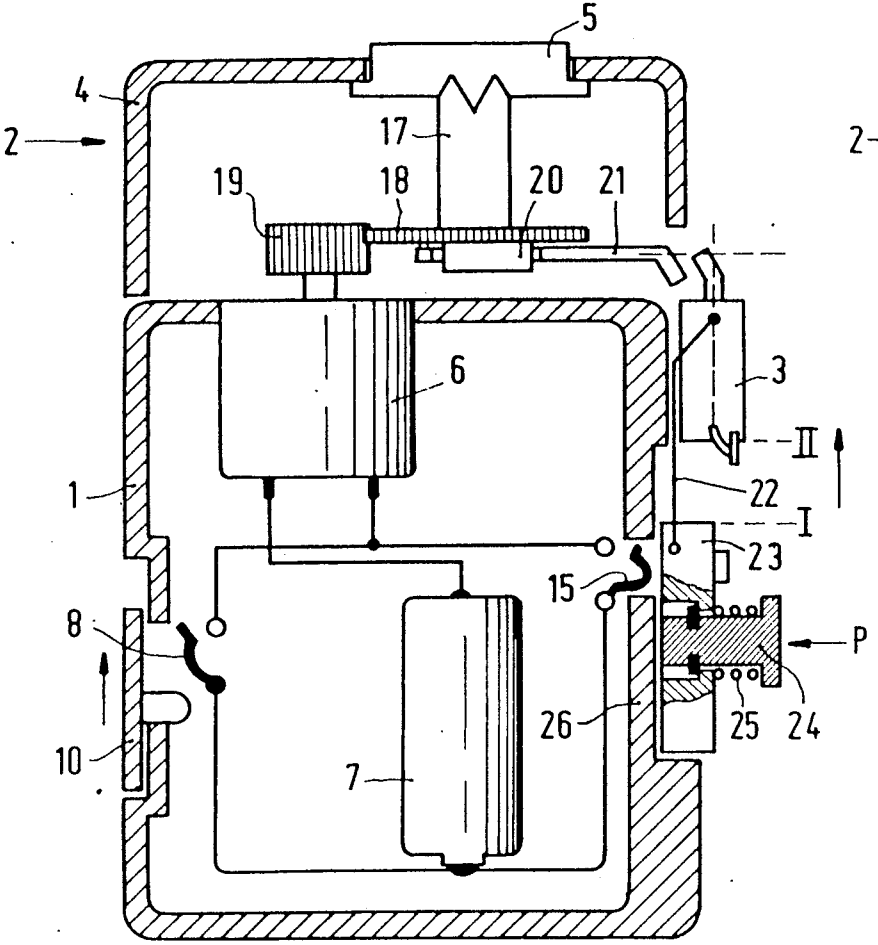

In the embodiment according to FIGS. 5 and 6 the same reference numbers as those in FIGS. 1 to 4 are used for corresponding parts.

The housing 1 and the shaving part 2 are shown in cross-section, while for the sake of simplicity only one cutting element 5, connected by means of the shaft 17 and the gear wheels 18 and 19 to the electric motor 6, is shown. The gear wheel 18 has an eccentric part 20, by means of which the trimmer 3 can be driven via the lever 21 in the known manner.

As shown schematically, the trimmer 3 is coupled by means of the lever 22 to the second control element 23.

In the situation shown in FIG. 5 the trimmer 3 is in the non-operational position. The third control element 24 is designed as part of the second control element 23. The third control element 24 can be moved against spring force of the compression spring 25 in the direction of the arrow P. In the situation shown in FIG. 5, the movement of the third control element 24 in the direction P is blocked by wall part 26 of the housing 1. In the situation shown in FIG. 6 the second control element 23 is pushed up, and the trimmer 3 is in the operational position. At the third control element 24 there is now an aperture 27 in wall part 26, through which, by depressing the third control element 24 in the direction P, the switch can be closed and the drive of the trimmer can be started. In this way, premature switching on of the motor 6 when the trimmer is not in the operational position is prevented.

The design can e.g. be such that the trimmer 3 is driven only so long as the third control element 24 is depressed.

It is also possible to couple the third control element 14 or 24 mechanically to a mechanical coupling mechanism between the drive mechanism and the shaving part, as known, for example, from DE-A 2,028,063 which corresponds substantially to U.S. Pat. Nos. 3,690,000 and 3,781,990. It is then possible, for example, to disconnect the shaving part from the motor by means of the third control element, so that during use of the trimmer only the latter is driven, and unnecessary energy loss is prevented.

I claim:

1. An electric shaver which comprises a shaving part for short hair and a trimmer for long hair which can be moved relative to the shaving part between an operational and a non-operational position, one wall of the shaver having a first control element 10 which is coupled to a first ON/OFF switching device for a drive mechanism, and another wall of the shaver having a second control element for movement of the trimmer between the operational and non-operational positions, and a third control element which is situated near the second control element and is coupled to a second ON/-OFF switching device for the drive mechanism whereby the trimmer may be positioned by the second control element and the drive mechanism switched on without changing the positioning of the trimmer.

2. An electric shaver according to claim 1, with a drive mechanism provided with an electric motor and a first control element for an electric switch in a supply circuit of the electric motor, whereby the third control element is mechanically coupled to the electric switch.

3. An electric shaver according to claim 2, wherein the third control element is coupled to the second control element.

4. An electric shaver according to claim 1, with a drive mechanism provided with an electric motor and a first control element for a first electric switch in a supply circuit of the electric motor, wherein the third control element for the drive mechanism for the trimmer is coupled to a second electric switch parallel to the first electric switch.

5. An electric shaver according to claim 1, wherein the third control element is designed as a part of the second control element for moving the trimmer.

6. An electric shaver according to claim 1, in which the second control element can be moved between a first position corresponding to a non-operational position of the trimmer and a second position corresponding to an operational position of the trimmer, wherein the third control element is blocked in the first position of the second control element.

7. Electric shaver according to claim 1, wherein the third control element is also a control element for a mechanical coupling mechanism between the shaving part and the drive mechanism.

* * * * *